US008567075B2

(12) United States Patent
Hetts et al.

(10) Patent No.: US 8,567,075 B2
(45) Date of Patent: Oct. 29, 2013

(54) LOOP PILE CUTTER

(75) Inventors: Michael Hetts, Cranberry Township, PA (US); Michael Drinkard, San Jose, CA (US); Tan Nguyen, Milpitas, CA (US)

(73) Assignee: Crain Cutter Company, Inc., Milpitas, CA (US)

( * ) Notice: Subject to any disclaimer, the term of this patent is extended or adjusted under 35 U.S.C. 154(b) by 308 days.

(21) Appl. No.: 12/843,443

(22) Filed: Jul. 26, 2010

(65) Prior Publication Data

US 2012/0017450 A1 Jan. 26, 2012

(51) Int. Cl.
*B26B 29/00* (2006.01)

(52) U.S. Cl.
USPC ..... 30/287; 30/290; 30/294

(58) Field of Classification Search
USPC ..... 30/162, 163, 278, 279.2, 280, 282, 283, 30/286, 287, 289, 290, 293, 294, 335, 299, 30/304, 314, 317, 315, 279.6; 7/103
See application file for complete search history.

(56) References Cited

U.S. PATENT DOCUMENTS

| | | | | | |
|---|---|---|---|---|---|
| 3,047,946 | A * | 8/1962 | Lins | ..... | 30/162 |
| 3,153,853 | A * | 10/1964 | Lipton | ..... | 30/294 |
| 3,543,400 | A | 12/1970 | Scott et al. | | |
| 3,621,573 | A * | 11/1971 | Summers | ..... | 30/287 |
| 5,272,947 | A * | 12/1993 | Peters | ..... | 83/455 |
| 5,881,463 | A | 3/1999 | Casteel et al. | | |
| 6,112,417 | A * | 9/2000 | Hyer et al. | ..... | 30/290 |
| 6,421,924 | B2 * | 7/2002 | Anderson et al. | ..... | 30/294 |
| 6,647,628 | B1 * | 11/2003 | Braaksma | ..... | 30/294 |

* cited by examiner

*Primary Examiner* — Stephen Choi
(74) *Attorney, Agent, or Firm* — Fenwick & West LLP

(57) ABSTRACT

A loop pile cutter includes an added blade holder thumbscrew that provides an additional clamping force to hold a blade holder right side and blade holder left side against a base mounting bracket. The added blade holder thumbscrew also guides the blade holder along the base mounting bracket. In particular, the added blade holder thumbscrew inserts within a slot in the base mounting bracket. Since the added blade holder thumbscrew is removable, the slot may be closed-ended. The combination of an added blade holder thumbscrew and a closed-ended slot in the base mounting bracket reduces deflection of the blade holder from carpet tufts that resist being parted by a center row guiding edge.

14 Claims, 4 Drawing Sheets

LOOP PILE CUTTER

BACKGROUND

This invention relates generally to flooring tools, and in particular to loop pile cutters used to cut seams in carpets.

A loop pile cutter is commonly used in carpet seaming. Modern carpets are constructed with tufts of colored yarn material that are knitted in rows into a backing material by machines. The tufts form the "face" of the carpet, which faces up and is visible on the floor of a room. The backing faces down and holds the yarns together.

The carpet is manufactured in standard width rolls. The roll widths are cut to the dimensions of the room. In many cases, they are seamed together with a hot melt adhesive tape to form a single, one piece floor covering. In other cases, primarily in commercial settings, the carpet is glued directly to a subfloor with seams simply abutted. In either case, the quality of the installation depends on proper preparation of the edges of the carpet forming the seams.

The loop pile cutter prepares carpet edges for seaming by trimming the backing material as closely as possible to a row of carpet tufts. Without this trimming, the rough edges of backing can protrude past the tufts. This can create unsightly gaps at the seam. Loop pile cutters have a left blade and a right blade, which allow the tool to trim the carpet close to the tufts on both sides of the seam, greatly reducing such gaps.

As described in U.S. Pat. No. 3,543,400 to Scott, and U.S. Pat. No. 5,881,463 to Casteel, the distinguishing feature of a loop pile cutter (compared with other carpet seam cutters) is a blade holder that is adjustable in height in relation to a base. With reference to FIG. 1 of Scott, the base 14 is made with a supporting plate 12 with two L-shaped angle members 69 forming the base bottom. The base 14 rides on a subfloor. Supporting plate 12 has slot 38, and arm portion 18. Arm portion 18 has an inclined upper edge 20. Both slot 38 and upper edge 20 are formed at an acute angle of about 30 degrees in relation to the base 14. Slot 38 and upper edge 20 form the guide surfaces for the height adjustment of the blade holder.

The blade holder that fastens on the base 14 is formed with a pair of left and right retaining plates 24 welded to a guide plate 28 (FIG. 3) forming a center. Guide plate 28 forms carpet engaging edge 32 which guides the cutter between rows of carpet tufts.

The retaining plates are also riveted together along with handle 26 at two upper flat areas. As shown in FIG. 3, these flat areas are bordered by of two angled, upwardly jogging "shoulders" 25. The angle of the shoulders 25 corresponds to the upper edge 20 of arm portion 18 (FIG. 1) once the blade holder of this cutter is assembled onto base 14. Thus, shoulders 25 (FIG. 3) ride upon and are guided by the inclined plane defined by upper edge 20 of arm portion 18 (FIG. 1). As shown in FIG. 1, this incline defines a range of height adjustment for the blade holder in relation to the base 14.

As shown in FIG. 1, the blade holder has had two nuts 42 (not shown) welded onto a retaining plate outer surface. The nuts 42 (not shown) receive two threaded thumb screws 36, 64. Thumb screw 36 runs through slot 38 for to hold the blade holder at a selective height above base 14. When thumb screw 36 is tightened into a first nut 42, the inside of retaining plates 24 are clamped and frictionally held against the outside of supporting plate 12. This clamping action of thumb screw 36 holds the blade carrier at a height above base 14.

As shown in FIG. 5, blades 54, 56 are held on their outer surfaces by the inner walls of retaining plates 24. These inner walls form recesses 48, 50 (FIGS. 2 and 3). As shown in FIG. 5, blades 54, 56 are held on their inner surfaces by guide plate 28 that forms carpet engaging edge 32 (FIG. 1). Left and right blades 54, 56 are offset slightly from the centerline of the cutter by a half thickness of guide plate 28.

As further shown in Scott's FIG. 1, a second thumb screw 64 is threaded into a second nut 42 (not shown) welded onto a retaining plate outer surface. Thumb screw 64 serves primarily to adjustably hold left and right blades 54, 56 (FIG. 3) within blade recesses 48 and 50 (FIGS. 2 and 3). The angle of blade recesses 48 and 50 (FIG. 2) in relation to base 14 is the same 30 degree angle as upper edge 20 of arm portion 18 and slot 38 for height adjustment.

The reason that the blades 54, 56 must be adjusted in height within the area defined by blade recesses 48, 50 (FIG. 2) is as follows: The blade holder must be moved up or down to accommodate various thicknesses of carpet. As the blade holder is moved up or down on upper edge 20 of base 14, blades 54, 56 must be correspondingly extended or retracted so that they may seat within a recesses 58 in base 14 (FIG. 1). As shown in FIGS. 1 and 3, recesses 58 keep blades 54, 56 from deflecting horizontally due to resistance from the carpet.

Deflection of the blades themselves could result in the cutter shearing off parts of carpet tufts which are meant to be preserved, or could also result in carpet backing material not being trimmed. To produce the best looking seam, both these problems must be avoided. Hence, all the loop pile cutters discussed herein have blade holders similar to recesses 48, 50 (Figure and 3) and recesses 58 (FIGS. 1 and 3) to prevent deflection of the blades.

As further shown in Scott's FIG. 1, the approximately 30 degree angle formed by blade recesses 48 and 50 (FIG. 3), the inclined upper edge 20 of support plate 12, and slot 38, are designed to place the blades 54, 56 approximately at a 30-degree angle in relation to carpet entering at carpet receiving slot 34. This angle is preferred because it exposes a long surface of blades 54, 56 where the cross section of the carpet backing is expected to pass. A lower angle may cause the carpet tufts to trap under the blade and be sheared. A higher angle would place less blade surface in the area of the carpet backing, resulting in faster blade wear, less efficient cutting, both of which can cause the carpet to rise up and wad against carpet engaging edge 32.

Thus, the loop pile cutter of Scott provides a base and a blade holder that is adjustable in height. As shown in FIG. 1, a carpet edge to be trimmed enters a carpet receiving slot 34 defined as the open area between the edge referred to as carpet receiving slot 34 of base 14 and the lower edge of carpet engaging edge 32. The height adjustment allows carpets of various thicknesses (varying by height of tufts and thickness of carpet backing) to enter carpet receiving slot 34. Carpet engaging edge 32 guides the cutter between two rows of carpet tufts as the user pushes on handle 26 (FIG. 1).

In use, as shown in FIG. 1, first the height of the blade holder must be adjusted such that carpet engaging edge 32 of guide plate 28 (FIG. 5) presses deep between two rows of carpet tufts all the way down to the carpet backing (best seen in FIG. 5). Thumb screw 36 is tightened to hold this height.

Regarding the selection of the left blade 54 and right blade 56, the directional terms left and right in the disclosure of Scott are made from the perspective of section 3-3 facing down carpet engaging slot 34 in the direction of the blades. As shown in FIG. 4, a left blade 54 is extended into a recess 58 (FIG. 1) in base 14 in order to trim close to a left side of a carpet tuft (making "cut" 78). In such case, a right blade 56 is retracted (raised up) into blade recess 50 (FIG. 3) so that it will not cut any carpet. Alternatively, as shown in FIG. 5, a right blade 56 is extended into a recess 58 (FIGS. 1 and 3) to trim close to a right side of a carpet tuft (making cut 80). In such case, a left blade is 54 is retracted (raised up) into a recess 48 so that it will not cut any carpet. With both edges of the carpet prepared in this manner, the carpet tufts should abut precisely with no gap due to excess carpet backing. This produces an improved carpet seam.

However, as the loop pile cutter of Scott is pushed through a row of carpet, the carpet engaging edge 32 (FIG. 1) encounters side loads from carpet tufts which resist being parted. As shown in FIG. 3, to the extent that there is play between side plates 24 and upper arm 18 of base 12, these side loads can cause shifting of the entire blade holder to the left or right off the centerline of base 14. The side loads can also cause bending of supporting plate 12. This shifting of the components and bending of the main base bracket component (supporting plate 12) will be referred to as deflection of the blade holder. Deflection of the blade holder can cause the cutter to turn to the left or the right as it moves between the rows of tufts. This can cause the cutter to shear tufts close to the blade, or even skip out between the rows of tufts which are intended, into another adjacent set of tuft rows. If such skipping occurs, the edge will not match with another properly cut edge, and the trimming operation on the improperly cut side must be repeated.

With the cutter of Scott, as shown in FIG. 1, the cutter's main resistance to deflection is the clamping action of thumb screw 36 holding retaining plates 24 against arm portion 18 of supporting plate 12. Only one thumb screw is provided to produce all necessary clamping force, and the position of this screw is at considerable distance from side loads that cause the deflection. Some means of reducing the deflection of the blade holder assembly would tend to reduce the undesirable shearing of tufts or skipping out of tuft rows that may occur.

Another loop pile cutter with a different blade holder construction is disclosed in U.S. Pat. No. 5,881,463 to Casteel. As shown in Casteel's FIG. 2, the loop pile cutter has a similar base 102 and a mounting bracket 104. Mounting bracket 104 has an open-ended slot 114 for holding a blade carrier, and a second slot 112, which is closed-ended. The angle formed by the centerlines of both slots 112, 114 in this cutter is the same 30 degree angle as in Scott.

As shown in FIG. 1, blade support 300 is an assembly forming the blade holder of this cutter. Blade support 300 includes a center plate 301 (FIG. 8). As shown in FIG. 8, center plate 301 has a tongue 302. Tongue 302 has also has a centerline at a 30 degree angle in relation to its bottom edge. This makes tongue 302 insertable into open-ended slot 114 of mounting bracket 104 (FIG. 2). Tongue 302 can thus be slideably positioned on the incline of open-ended slot 114 (FIG. 2). As shown in FIG. 1, this allows blade support 300 to be positioned at a selective height above base 102 (FIG. 2). As shown in FIG. 8, center plate 301 also has a hole 306 for passage of a threaded fastener.

To form the blade holders of this cutter, as shown in FIGS. 9 and 10, bar spacers 308, 308' and nose spacers 310, 310' are attached (as by welding or riveting) to either side of center plate 301. The bottom edges of bar spacers 308, 308' form top bearing surfaces 312, 312'. These define the top boundary of the left blade compartment 319 and right blade compartment 319' (FIG. 13), respectively. The top edges of nose spacers 310, 310' form bottom bearing surfaces 314, 314'. These define the bottom boundary of the left blade compartment 319 and right blade compartment 319' (FIG. 13), respectively. As with blade recesses 48 and 50 of Scott, left blade holder 319, and right blade holder 319' hold the blade at about a 30 degree angle in relation to base 14.

As shown in FIG. 13, left side plate 316 and right side plate 316' are mounted as by riveting or welding onto bar spacers 308, 308' and nose spacers 310, 310'. Left side plate 316 and right side plate 316' define the outer boundary of left blade compartment 319 and right blade compartment 319'. As shown in FIGS. 11 and 12, the left side plate 316 and right side plate 316' additionally have "openings" that align with hole 306 through center plate 301 (FIG. 8).

As shown in FIG. 1, threaded fastener 10 may pass through the "openings" in side plates 316, 316' (FIGS. 11 and 12), though hole 306 (FIG. 8) in the center plate, and then be threaded into in a nut (not shown) attached to a side plate outer surface. As shown in FIG. 1, tightening the threaded fastener 10 holds the blades 14, 14' at a height within the blade support assembly 300.

Bar spacers 308, 308' and nose spacers 310, 310' (FIGS. 9 and 10) serve one additional function in that, once attached to center plate 301 (FIG. 8) and left side plate 316 and right side plate 316' (FIGS. 11 and 12), they hold all these components together if threaded fastener 12 (FIG. 1) is removed. As shown in FIG. 1, this is helpful if blade support assembly 300 must be removed from base 102 (FIG. 2). This may be required during maintenance or cleaning of the cutter.

As shown in FIGS. 11 and 12, left side plate 316 and right side plate 316' additionally have holes 318, 318' respectively for insertion of a second threaded fastener 12 (FIG. 1). Threaded fastener 12 (FIG. 1) passes through a hole 318 in left side plate 316 (FIG. 12), slot 112 in mounting bracket 104 (FIG. 2), hole 318' in right side plate 316' (FIG. 11), and threads into a nut (not shown) mounted on a side plate outer surface. As shown in FIG. 1, when threaded fastener 12 is tightened, the inner surfaces of left and right side plates 316, 316' (FIGS. 11 and 12) are clamped and frictionally held against mounting bracket 104 of base plate 100 (FIG. 2), holding blade support 300 (FIG. 1) at a selective height.

The cutter of Casteel has the same or worse problems of deflection of its blade holder. As shown in FIG. 1, threaded fastener 12 provides the only resistance to side loads, but is again at a distance from the outer end of blade support 300 (element 18). The loop pile cutter also includes bar spacers 304, 304', and nose spacers 310, 310' (FIGS. 9 and 10) forming the blade compartments. These actually tend to hold left side plate 316 and right side plate 316' (FIGS. 11 and 12) apart. This creates built-in play between the inner surfaces of left side plate 316 and right side plate 316' (FIGS. 11 and 12) and mounting bracket 104 (FIG. 2). As a result, threaded fastener 12 is less able to clamp the inner surfaces of left side plate 316 and right side plate 316' (FIGS. 11 and 12) against mounting bracket 104 (FIG. 2).

Furthermore, as shown in FIG. 2, slot 114 which accepts tongue 302 of center plate 301 (FIG. 8), is open-ended. In use, as blade support assembly 300 (FIG. 1) encounters resistance from carpet tufts and begins to deflect, the open-ended shape slot 114 of promotes bending of mounting bracket 104. If this open-ended slot 114 were closed-ended, the bending resistance of mounting bracket 104 may be improved, and blade support assembly 300 would have greater resistance to deflection.

As shown in FIG. 12, open-ended slot 114 (FIG. 2) is formed with an open end so that tongue 302 of center plate 301 (FIG. 8) of blade holder assembly 300 (FIG. 1) can be removed entirely from open-ended slot 114 (for maintenance, for example). Open ended slot 114 is economical in that no additional parts are required to provide the functions of a holder and an inclined plane for adjustably mounting blade holder assembly 300. However, open ended slot 114 promotes bending of mounting bracket 104.

Therefore, for several reasons, blade support 300 of the loop pile cutter of Casteel may deflect even more under side loads than the blade holder of Scott.

Another prior art loop pile cutter with a different blade holder construction, manufactured by Crain Cutter Company, is shown in FIG. 1 of this application. Loop pile cutter 10000 has a base 10200 with a base mounting bracket 10205. As shown in FIG. 2, base mounting bracket 10205 includes an open ended slot 10210, a blade holder screw slot 10215, a flat 10220, and bottom edge 10225. The centerlines of open ended slot 10210, blade holder screw slot 10215, as well as the angle formed by bottom edge 10225, all form an approximately 30 degree angle in relation to a base bottom surface 10230 of base 10200.

The exploded view of blade holder 10500 in FIG. 2 shows holder right side 10505, holder center 10540, and holder left side 10570. Holder right side 10505 includes right inward jog 10510, right spot weld surface 10515, right partial pierce 10520, right hand attached nut 10525, and a blade holder screw through hole 10530. Holder left side 10570 includes left inward jog 10575, left spot weld surface 10580, left partial pierce 10585, left hand attached nut 10590, and a blade thumbscrew passage hole 10595. Right inward jog 10510 and left inward jog 10575 are also at a 30 degree angle in relation to base bottom surface 10230 once assembled onto base 10200. Holder center 10540 includes a center row guiding edge 10545, and a center blade screw passage hole 10550.

Blade holder 10500 is assembled by spot welding blade holder center 10540 between holder right side 10505 and holder left side 10570 at right spot weld surface 10515 and left spot weld surface 10580. After spot welding, holder right side 10505 and left side 10570 abut one another at right partial pierce 10520 and left partial pierce 10585.

The function of the abutting surfaces formed by right partial pierce 10520 and left partial pierce 10585 is to produce an inexpensive pair of guide surfaces on both parts, which is insertable within open ended slot 10210. Once inserted into slot 10210, these guide surfaces serve to guide the height adjustment of blade holder 10500 at an angle of approximately 30 degrees in relation to base 10200.

As shown in FIG. 1, blade holder center 10540, once spot welded together with holder right side 10505 and holder left side 10570, forms the center row guiding edge 10545 of the cutter, as well as blade pocket separator 10555.

As shown in FIG. 2, right inward jog 10510 of holder right side 10505 forms the bottom of right blade pocket 10535. Left inward jog 10575 of holder left side 10570 forms the bottom edge of a left blade pocket 10600. Bottom edge 10225 of base holder bracket 10205 forms the top of both right blade pocket 10535 and left blade pocket 10600.

Right slotted razor blade 10625 is held in right blade pocket 10535, and left slotted razor blade 10650 is held in left blade pocket 10600. Right slotted razor blade 10625 and left slotted razor blade 10650 are held at a selective height within right blade pocket 10535 and left blade pocket 10600 by blade thumb screw 10675. Blade thumb screw 10675 passes though blade screw passage hole 10595 of holder left side 10570, through the slot of left slotted razor blade 10650, through center blade screw passage hole 10550, through the slot of right slotted razor blade 10625, and threads into right hand attached nut 10525. Thus, when blade thumbscrew 10675 is tightened, blade holder right side 10505 is drawn inward to clamp and frictionally hold right slotted razor blade 10625 at a height. The blade thumbscrew head bottom 10676 of holding thumbscrew 10675 tightens down on the outer face 10651 of left slotted razor blade 10650 to frictionally hold left slotted razor blade 10650 at a height.

Blade holder thumb screw 10400 passes through a blade holder screw through hole 10530 in holder right side 10505, a holder slot 10215 in base mounting bracket 10205, and threads into a left hand attached nut 10590. Thus, as lower holder thumbscrew 10400 is tightened, holder right side 10505 and holder left side 10525 are drawn together and frictionally held against flat 10220 of base mounting bracket 10205. As shown in FIG. 1, thumb screw 10400 provides the cutter's main resistance to side loads at row guiding edge 10545 causing deflection of blade holder 10500.

Much as with the cutters of Scott and Casteel, as shown in FIG. 1, blade holder thumb screw 10400 is at a distance from center row guiding edge 10545, which reduces its ability to resist deflection. Much with as the bar spacers 308, 308' and nose spacers 310, 310' (FIGS. 9 and 10) of Casteel, the abutting left partial pierce 10520 and right partial pierce 10585 work as a permanent separator between holder left side 10505 and holder right side 10570. As shown in FIG. 2, this separation further reduces the ability of body holder screw 10400 to effectively clamp holder right side 10505 and holder left side 10570 against base holder bracket 10205. The result is that the blade holder can deflect. Much as with the cutter of Casteel, open ended slot 10210 promotes bending of base mounting bracket 10205, further reducing the ability blade holder 10500 to resist deflection.

What is needed is a loop pile cutter with an improved blade holder assembly and blade holder mounting bracket in its base that can better resist deflection.

SUMMARY

Embodiments of the invention comprise a loop pile cutter with an added blade holder thumbscrew that provides an additional clamping force to hold a blade holder right side and blade holder left side against a base mounting bracket. The added blade holder thumbscrew also guides the blade holder along the base mounting bracket. In particular, the added blade holder thumbscrew inserts within a slot in the base mounting bracket, which in one embodiment is formed at a 30-degree angle in relation to the base of the tool once assembled. Since the added blade holder thumbscrew is removable, the slot may be closed-ended. The combination of an added blade holder thumbscrew and a closed-ended slot in the base mounting bracket reduces deflection of the blade holder from carpet tufts that resist being parted by a center row guiding edge.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 3:
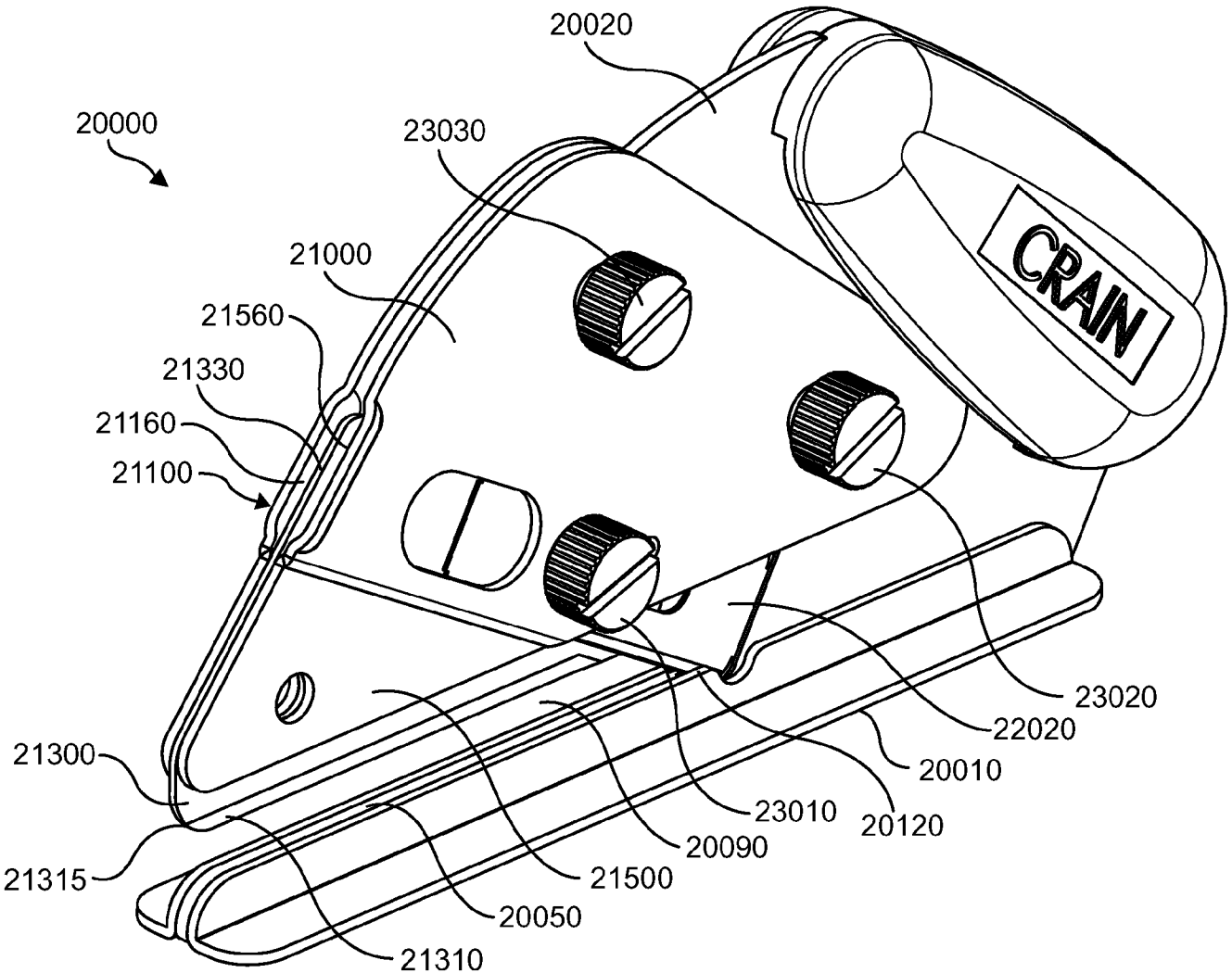
FIG. 3 is a perspective view of a loop pile cutter, in accordance with an embodiment of the invention.

As shown in FIG. 3, loop pile cutter 20000 of the present invention has a blade thumbscrew 23010, and a lower blade holder thumbscrew 23020, which are similar to the prior art loop cutters. Loop pile cutter 20000 additionally has upper blade holder thumb screw 23030. With regard to loop pile cutter 20000 of the present invention, blade thumbscrew 23010 is described as a "blade thumbscrew" because its function is to hold the blades within blade holder 21000.

In contrast, it is not the function of blade thumbscrew 23010 to hold the blade holder 21000 on a base mounting bracket 20020. Instead, holding the blade holder 21000 is the function of lower blade holder thumbscrew 23020 and upper blade holder thumb screw 23030. Hence, lower blade holder thumbscrew 23020 and upper blade holder thumb screw 23030 are referred to as "blade holder thumbscrews."

Figure 4:
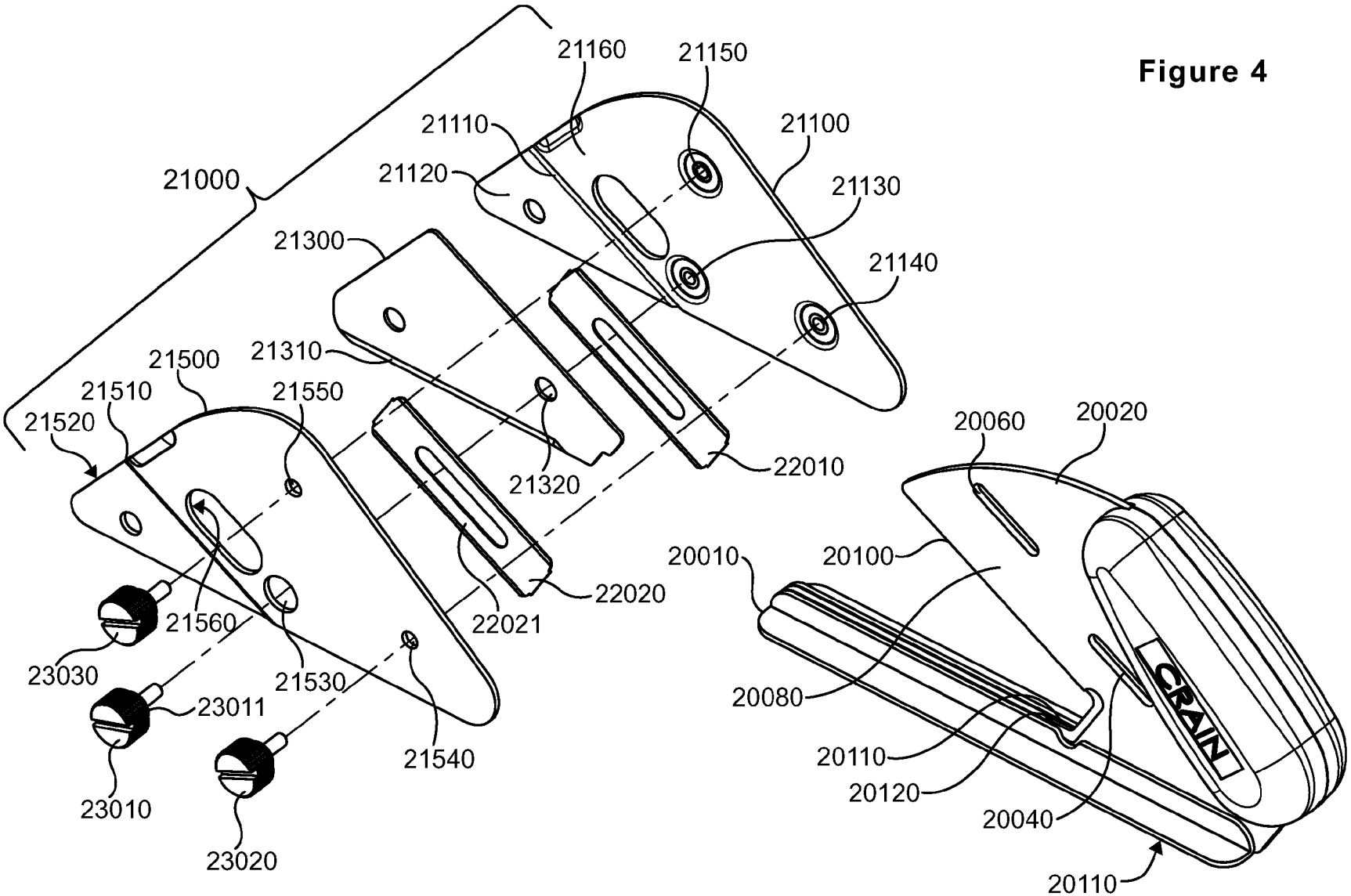
FIG. 4 is an exploded view of the loop pile cutter of FIG. 3.

As shown in FIG. 3, loop pile cutter 20000 has a base 20010 with a base mounting bracket 20020, and blade holder 21000. As shown in FIG. 4, base mounting bracket 20020 has two closed-ended slots for clamping blade holder 21000 onto base mounting bracket 20020, lower blade holder slot 20040, and upper blade holder slot 20060. Base mounting bracket 20020 additionally has a flat 20080, and a bottom edge 20100. The centerlines of lower blade holder slot 20040 and upper blade holder slot 20060, as well as the angle formed by bottom edge 20100, all form an angle of 30 degrees in relation to a base bottom surface 20110 of base 20010.

The exploded view of the parts of the blade holder 21000 shows a holder right side 21100, holder center 21300, and a holder left side 21500. Holder right side 21100 includes a right inward jog 21110, right spot weld surface 21120, right blade attached nut 21130, right lower blade holder attached nut 21140, and right upper blade holder attached nut 21150. Holder left side 21500 includes a left inward jog 21510, a left spot weld surface 21520, a left blade through hole 21530, left lower blade holder through hole 21540, and a left upper blade holder through hole 21550. Right inward jog 21110 and left inward jog 21510 will also be at a 30-degree angle in relation to base bottom surface 20110 when assembled with base 20010. Holder center 21300 includes center row guiding edge 21310, and center blade through hole 21320.

Blade holder 21000 is assembled by spot welding holder center 21300 between holder right side 21100 and holder left side 21500 at right spot weld surface 21120 and left spot weld surface 21520. As shown in FIG. 3, blade holder center 21300, after being spot welded between holder right side 21100 and holder left side 21500, forms center row guiding edge 21310 and blade pocket separator 21330 defining two blade pockets within blade holder 21000.

As shown in FIG. 4, right inward jog 21110 of holder right side 21100 forms the bottom edge of a right blade pocket 21160. Left inward jog 21510 forms the bottom edge of a left blade pocket 21560. Bottom edge 20100 of base mounting bracket 20020 forms the top of both right blade pocket 21160 and left blade pocket 21560.

Right slotted razor blade 22010 is held in right blade pocket 21160 and left slotted razor blade 22020 is held in left blade pocket 21560. Right slotted razor blade 22010 and left slotted razor blade 22020 are held at a selective height by blade thumbscrew 23010. Blade thumbscrew 23010 passes through a left blade through hole 21530, the slot in left slotted razor blade 22020, center blade through hole 21320, the slot in right slotted razor blade 22010, and threads into right blade attached nut 21130. When blade holding thumbscrew 23010 is tightened, blade holder right side 21100 is drawn towards blade holder center 21300, which clamps right blade 22010 at a height. Blade thumbscrew head bottom 23011 bears on an outer surface 22021 of left slotted razor blade 22020 to hold left slotted razor blade 22020 at a height.

Lower blade holder thumbscrew 23020 passes through left lower blade holder through hole 21540, lower blade holder slot 20040 in base mounting bracket 20020, and threads into right lower blade holder attached nut 21140. Thus, as lower blade holder thumbscrew 23020 is tightened, holder right side 21100 and holder left side 21500 are drawn together and frictionally held against flat 20080 of base mounting bracket 20020.

As shown in FIG. 4, upper blade holder thumbscrew 23030 passes through left upper blade holder through hole 21550, upper blade holder slot 20060 in base mounting bracket 20020, and threads into right upper blade holder attached nut 21150. Thus, as upper blade holder thumbscrew 23030 is tightened, holder right side 21100 and holder left side 21500 are further drawn together and frictionally held against flat 20080 of base mounting bracket 20020.

Figure 2:
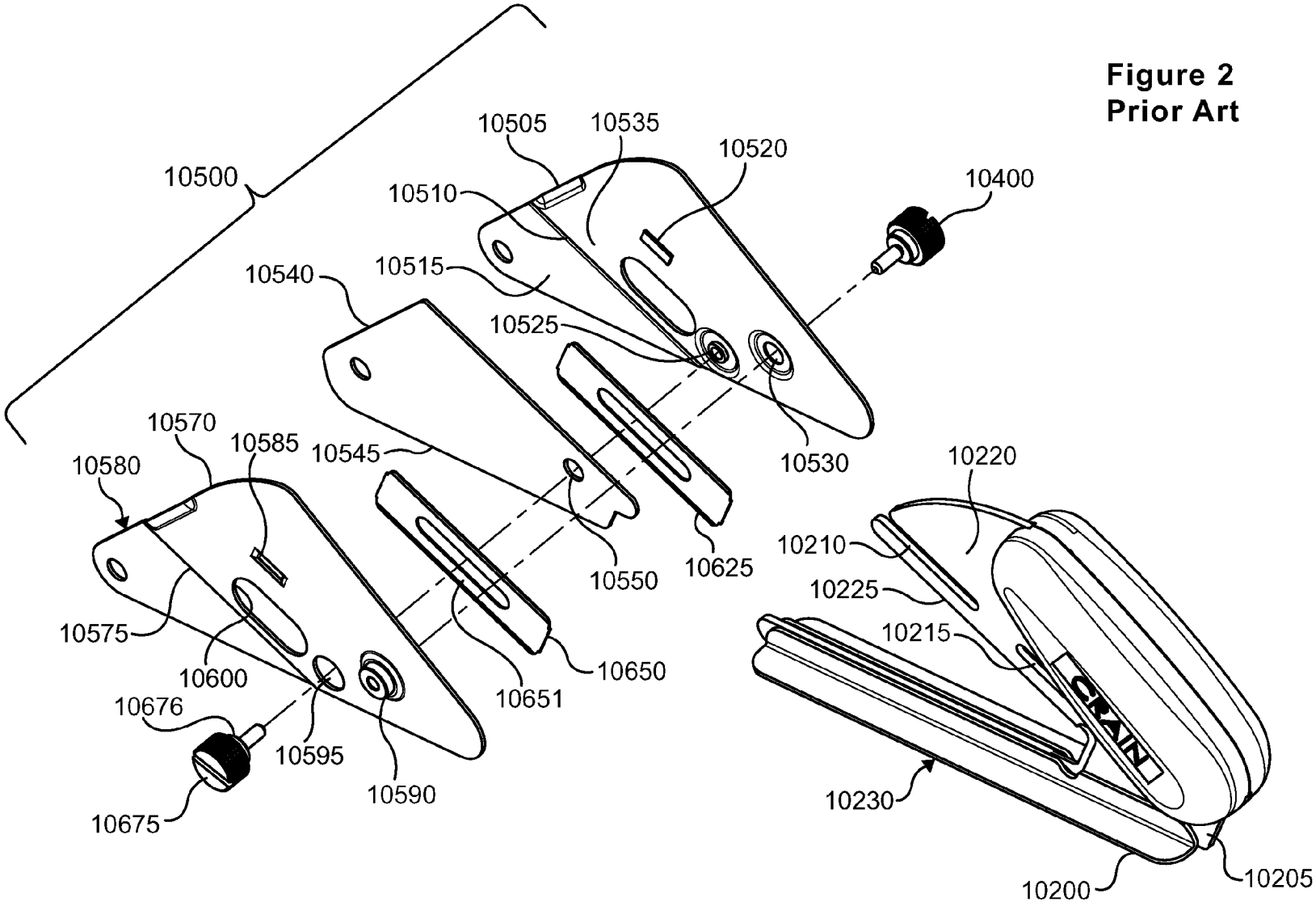
Figure 2 Prior Art
FIG. 2 is an exploded view of the loop pile cutter of FIG. 1.

In the loop pile cutter 20000 of an embodiment of the invention, upper blade holder thumbscrew 23030 and lower blade holder thumbscrew 23020, once tightened, cooperatively clamp holder right side 21100 and holder left side 21500 and against a base mounting bracket 20020. The lack of a member that causes spreading, such as shoulders 25 of Scott (FIG. 3), or bar spacers 308, 308' and nose spacers 310, 310' of Casteel (FIGS. 9 and 10), or the abutting right partial pierce 10520 and right partial pierce 10585 of Crain (FIG. 2), combined with the increased clamping force from upper blade holder thumbscrew 23030, produce uniform, face to face contact between the inner sides of holder right side 21100, holder left side 21500, and base mounting bracket 20020. This minimizes play in the assembly and increases the ability of the blade holder 21100 to resist deflection.

Figure 1:
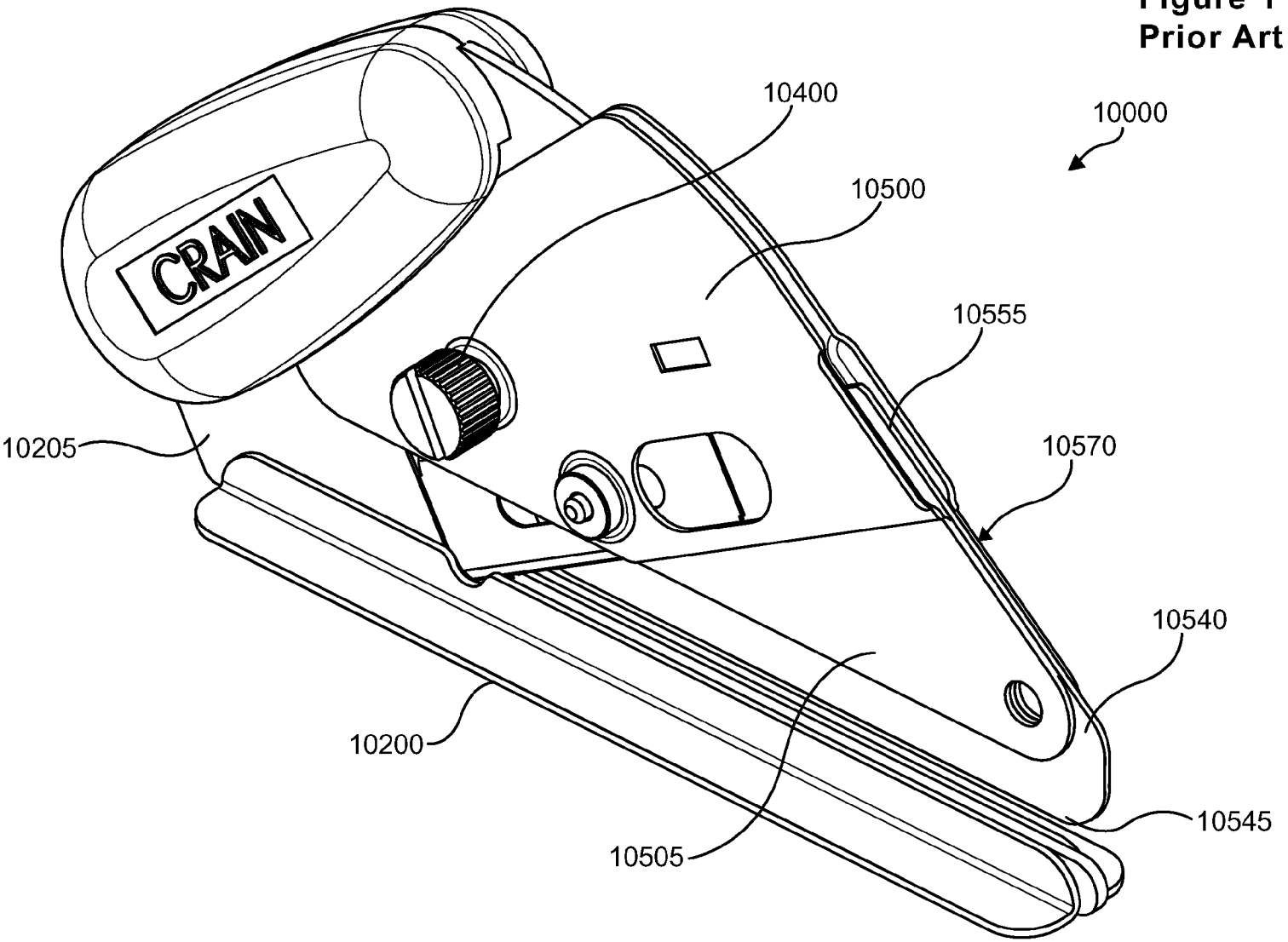
Figure 1 Prior Art
FIG. 1 is a perspective view of a prior art loop pile cutter.

As shown in FIG. 3, the positioning of upper blade holder thumbscrew 23030 is closer in proximity to an end 21315 of center row guiding edge 21310 than lower blade holder thumbscrew 23020. It is also closer to an end of a center row guiding surface than the thumbscrew 36 (FIG. 1) of Scott, threaded fastener 12 of Casteel (FIG. 1), or thumbscrew 10400 (FIG. 1) of Crain. While these elements all perform the function of clamping a blade holder to a base mounting bracket, upper blade holder thumbscrew 23030 is positioned better to resist the leverage generated by side loads from carpet tufts on center row guiding edge 21310 (FIG. 3) which can cause deflection of blade holder 21000.

As previously explained, from time to time a loop pile cutter may need to be disassembled for maintenance or cleaning. When such is necessary with the loop pile cutter 20000, as shown in FIG. 4, lower blade holder thumbscrew 23020 and upper blade holder thumbscrew 23030 are removed from lower blade holder slot 20040 and upper blade holder slot 20060 in base mounting bracket 20020. This allows the blade holder 21000 to be removed from base 20010 for maintenance or cleaning.

As shown in FIG. 4, because upper blade holder thumbscrew 23030 is removable, upper blade holder slot 20060 may be closed-ended. This improves the ability of base mounting bracket 20020 to resist bending forces generated by side loads from carpet tufts on center row guiding edge 21310 (FIG. 3).

In use, as shown in FIG. 3, first of all the loop pile cutter 20000 is adjusted to the thickness of carpet. If new blades are to be installed, blade holding thumbscrew 23010 is removed. Loop pile cutter 20000 is placed on a subfloor surface (surface beneath the loose piece of carpet being trimmed). Lower blade holder thumbscrew 23020 and upper blade holder thumbscrew 23030 are loosened. This allows the blade holder 21000 to be raised or lowered at a 30 degree angle in relation to base 20010. Blade holder 21000 is raised to the height of the tufts of the carpet, then pressed downward as deeply as possible between two rows of carpet tufts until center row guiding edge 21310 contacts the carpet backing. This sets the proper height of center row guiding edge 21310 in relation to base 20010. Once at proper height, the carpet can enter at the space between a base top surface 20050 and center row guiding edge 21310, which will be referred to as a carpet opening 20090. Once the carpet is inserted at carpet opening 20090, center row guiding edge 21310 can guide loop pile cutter 20000 between two rows of carpet tufts.

As shown in FIG. 3, once the proper carpet opening 20090 is set, any standard slotted razor blades, such as left slotted razor blade 22020 and right slotted razor blade 22010 (FIG. 4), may be inserted into right blade pocket 21160 or a left blade pocket 21560. If a right edge of carpet is to be trimmed for seaming, left slotted razor blade 22020 is lowered into a left blade holding channel 20120 in base 20010. (Right blade holding channel 20110 and left blade holding channel 20120 are more easily seen in FIG. 4.) When a right edge of the carpet is to be trimmed, an opposite side right slotted razor blade 22010 (FIG. 4) will be held up out of the way within right blade pocket 21160 (FIG. 4) such that it will not cut any carpet. As shown in FIG. 3, once right slotted razor blade 22010 (FIG. 4) and left slotted razor blade 22020 (FIG. 4) are properly positioned, blade holding thumbscrew 23010 is tightened, clamping the blades at that height.

As shown in FIG. 3, once carpet is inserted into carpet opening 20090, with center row guiding edge 21310 guiding loop pile cutter 20000 between two rows of carpet tufts, left slotted razor blade 22020 will cut as close as possible to a row of carpet tufts on a right edge of carpet that is becoming the right side of a seam. Any excess carpet backing on a right side of the carpet is removed by left slotted razor blade 22020.

As shown in FIG. 4, if a left side of a carpet is to be trimmed, a right slotted razor blade 22010 is lowered into a right blade holding channel 20110, and a left slotted razor blade 22020 is raised up in left blade pocket 21560 out of the way so that it will not cut. Blade holding thumbscrew 23010 is tightened. As shown in FIG. 3, carpet is inserted into carpet opening 20090, with center row guiding edge 21310 guiding loop pile cutter 20000 between two rows of tufts. Right slotted razor blade 22010 (FIG. 4) will cut as close as possible to a row of carpet tufts on a left edge of carpet.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure. Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. A loop pile cutter comprising:

a base;

a base mounting bracket fixedly attached to and extending from the base, the base mounting bracket comprising a first slot and a second slot formed at an angle in relation to the base;

a blade holder having a center, a right side and a left side, and forming a blade pocket, the blade holder arranged to fit over the base mounting bracket such that the base mounting bracket is between the right and left sides of the blade holder, the blade holder further comprising first and second holes through the right and left sides that correspond to the first and second slots of the base mounting bracket;

a first blade holder thumbscrew positionable through the first hole of the blade holder and through the first slot of the base mounting bracket, wherein the first blade holder thumbscrew, when tightened, applies a compression force to the blade holder right and left sides to secure the blade holder to the base mounting bracket; and a second blade holder thumbscrew positionable through the second hole of the blade holder and through the second slot of the base mounting bracket, wherein the second blade holder thumbscrew, when tightened, applies a compression force to the blade holder right and left sides to secure the blade holder to the base mounting bracket, wherein when the first blade holder thumbscrew and the second blade holder thumbscrew are loosened, the blade holder is movable along the angle of the first and second slots of the base mounting bracket to a selected height above the base.

2. The loop pile cutter of claim 1, further comprising:

a first threaded nut positionable at the left or right side of the blade holder at the first hole of the blade holder, and a second threaded nut positionable at the left or right side of the blade holder at the second hole of the blade holder, wherein the first and second nuts mate with the first and second blade holder thumbscrews.

3. The loop pile cutter of claim 1, wherein the first and second slots of the base mounting bracket are closed-ended.

4. The loop pile cutter of claim 1, wherein each of the first and second slots of the base mounting bracket form an angle with the base of about 30 degrees.

5. The loop pile cutter of claim 1, wherein the first and second slots of the base mounting bracket are parallel.

6. The loop pile cutter of claim 1, wherein the blade holder is free of an obstruction between the left and right sides of the blade holder that would resist a compression force applied at the first and second holes when the blade holder is installed over the base mounting bracket.

7. The loop pile cutter of claim 1, further comprising:

a blade thumbscrew positionable through a third hole of the blade holder, such that when a blade is inserted in the blade pocket of the blade holder, the blade thumbscrew, when tightened, applies a compression force to secure the blade in the blade pocket of the blade holder.

8. The loop pile cutter of claim 1, wherein second blade holder thumbscrew is closer to an end of a center row guiding edge of the blade holder than the first blade holder thumbscrew.

9. A loop pile cutter comprising:

a base assembly, the base assembly comprising a base and a base mounting bracket having a first slot and a second slot formed therethrough and at an angle in relation to the base, the base mounting bracket fixedly attached to and extending from the base;

a blade holder arranged to fit over the base mounting bracket, the blade holder comprising first and second holes that correspond to the first and second slots of the base mounting bracket;

first and second fasteners that, when installed through the first and second holes of the blade holder and through the first and second slots of the base mounting bracket, respectively, and then tightened, apply a compression force to secure the blade holder to the base mounting bracket;

a right blade pocket formed in the blade holder and configured to receive a blade therein;

a left blade pocket formed in the blade holder and configured to receive a blade therein; and a blade thumbscrew that, when installed through a third hole of the blade holder and then tightened, applies a compression force to secure the left and right blades with respect to the blade holder, wherein when the first and second fasteners are loosened, the blade holder is movable along an angle of the first and second slots of the base mounting bracket to a selected height above the base.

10. The loop pile cutter of claim 9, wherein the first and second slots of the base mounting bracket are closed-ended.

11. The loop pile cutter of claim 9, wherein each of the first and second slots of the base mounting bracket form an angle with the base of about 30 degrees.

12. The loop pile cutter of claim 9, wherein the first and second slots of the base mounting bracket are parallel.

13. The loop pile cutter of claim 9, wherein the blade holder is free of an obstruction that would resist a compression force applied at the first and second holes when the blade holder is installed over the base mounting bracket.

14. The loop pile cutter of claim 9, wherein second blade holder thumbscrew is closer to an end of a center row guiding edge of the blade holder than the first blade holder thumbscrew.

* * * * *